US006290197B1

(12) United States Patent
Newton

(10) Patent No.: US 6,290,197 B1
(45) Date of Patent: Sep. 18, 2001

(54) CHAIR HOLD DOWN DEVICE

(76) Inventor: Don R. Newton, 37500A Garretts Lake Rd., Shawnee, OK (US) 74804

( * ) Notice: Subject to any disclaimer, the term of this patent is extended or adjusted under 35 U.S.C. 154(b) by 0 days.

(21) Appl. No.: 09/393,950

(22) Filed: Sep. 10, 1999

(51) Int. Cl.[7] ..... A47C 7/00

(52) U.S. Cl. ..... 248/346.2; 248/501; 248/910; 297/463.1

(58) Field of Search ..... 248/910, 500, 248/501, 502, 499, 346.2; 297/463.1; 150/107, 108, 106, 114

(56) References Cited

U.S. PATENT DOCUMENTS

| | | | | |
|---|---|---|---|---|
| 3,747,887 | * | 7/1973 | Binkley | 248/501 |
| 4,576,664 | * | 3/1986 | Delahunty | 248/499 |
| 5,116,014 | * | 5/1992 | Slavens | 248/500 |
| 5,350,147 | * | 9/1994 | Paganus | 248/910 |
| 5,452,877 | * | 9/1995 | Riffle | 248/910 |
| 5,513,900 | * | 5/1996 | Iglesias | 248/201 |
| 5,526,836 | * | 6/1996 | Sigsworth | 150/107 |
| 5,599,001 | * | 2/1997 | Dwyer | 248/910 |

* cited by examiner

*Primary Examiner*—Alvin Chin-Shue
(74) *Attorney, Agent, or Firm*—Dunlap, Codding & Rogers, P.C.

(57) ABSTRACT

A portable hold down device removably connectable to a portable object, such as a portable folding chair, for maintaining the portable object in a substantially stable condition is provided. The portable hold down device is provided with a portable hold down assembly, a first connector assembly and a second connector assembly. The hold down assembly has a weight sufficient to maintain the object in the substantially stable condition when the hold down assembly is connected to the portable object. The first connector assembly is fastened to the hold down member. The first connector assembly is removably connectable to the portable object whereby when the first connector assembly is connected to the portable object, the portable object is maintained in the substantially stable condition. The second connector assembly is supported by at least one of the hold down assembly and the first connector assembly so as to be extendable outwardly therefrom. The second connector assembly is removably connectable to at least a portion of the portable object having a different orientation than the portion of the portable object to which the first connector assembly is removably connectable.

7 Claims, 4 Drawing Sheets

CHAIR HOLD DOWN DEVICE

CROSS-REFERENCE TO RELATED APPLICATIONS

Not Applicable.

STATEMENT REGARDING FEDERALLY SPONSORED RESEARCH AND DEVELOPMENT

Not Applicable.

BACKGROUND OF THE INVENTION

Portable folding chairs and other light-weight, portable equipment, such as folding picnic tables, and camping matts are known in the art. These portable objects are used in outdoor activities, such as camping and on porches and/or decks located in people's lawns. These portable objects are rather lightweight, which makes the portable objects suitable for camping, or movement about the lawn or deck. However, the lightweight nature of these portable objects also makes them susceptible to being moved or blown about in medium to high winds. The movement or blowing about of these portable objects is inconvenient not only in that the portable objects must be moved back to the desired location, but typically, the portable objects must also be cleaned or wiped off due to undesirable contact with the earth.

Rocks and sandbags have been positioned on some portable objects, such as the camping matts, to prevent such portable objects from being moved by the wind. Further, stakes have been utilized, in some instances, to secure portable objects to the earth. However, stakes are typically not practical in trying to stabilize a portable object when the portable object is positioned on hard outdoor surfaces, such as concrete or a deck.

It would represent a state in the art if one were to develop a portable hold down device which could be connected to the portable objects to prevent such portable objects from being moved and/or blown about by the wind. It is to such a portable hold down device which the present invention is directed.

SUMMARY OF THE INVENTION

The present invention is a portable hold down device which is connectable to a portable object, such as a portable folding chair, for maintaining the portable object in a substantially stable condition so that the wind will not move and/or blow the portable object about. The portable hold down device includes a portable hold down assembly having a weight sufficient to maintain the portable object in the substantially stable condition when the hold down assembly is connected to the portable object.

The portable hold down device also includes a first connector assembly fastened to the hold down assembly. The first connector assembly is connectable to the portable object whereby when the first connector assembly is connected to the portable object the portable object is maintained in a substantially stable condition.

Thus, it can be seen that the portable hold down device constructed in accordance with the present invention provides a relatively simple, and inexpensive device for preventing or reducing the blowing about and/or movement of the portable object in medium to heavy winds so as to eliminate the nuisance caused by the movement of the portable object.

Other advantages and features of the present invention will become apparent to those of ordinary skill in the art when the following detailed description is read in conjunction with the attached drawings and the appended claims.

DETAILED DESCRIPTION OF THE INVENTION

Figure 1:
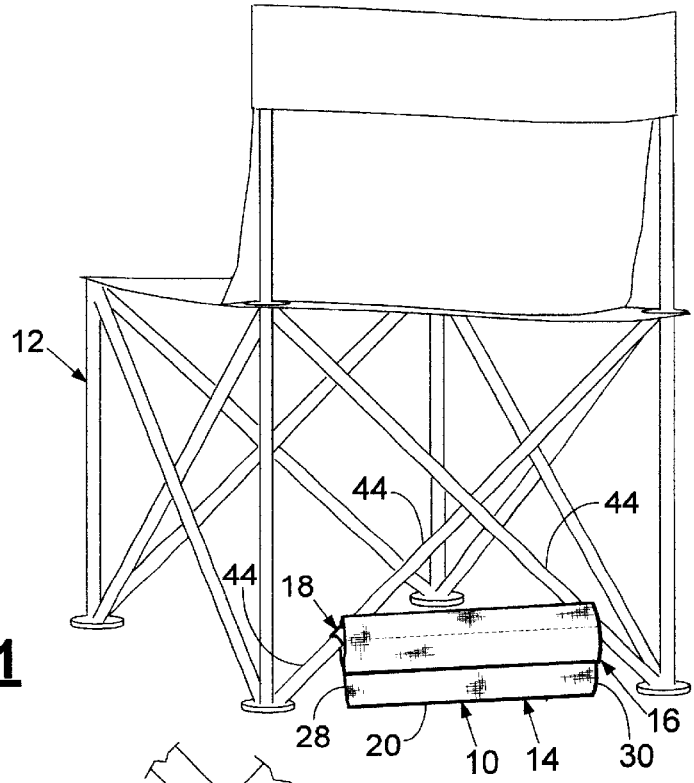
FIG. 1 is a perspective representation illustrating a portable hold down device constructed in accordance with the present invention removably connected to a portable object, such as a chair.

Referring now to the drawings, and in particular to FIG. 1, shown therein and designated by the reference numeral 10 is a portable hold down device constructed in accordance with the present invention. The portable hold down device 10 is connectable to a lightweight, portable object 12 for maintaining the portable object 12 in a substantially stable condition. Preferably, the portable hold down device 10 is removably connectable to a lower portion of the portable object 12 to prevent or reduce the likelihood that the portable object 12 will be tipped over or moved about by the wind. The term "removably" as used herein means that the portable hold down device 10 can be removed from the portable object 12 without destruction of the portable hold down device 10 or the portable object 12.

Figure 6:
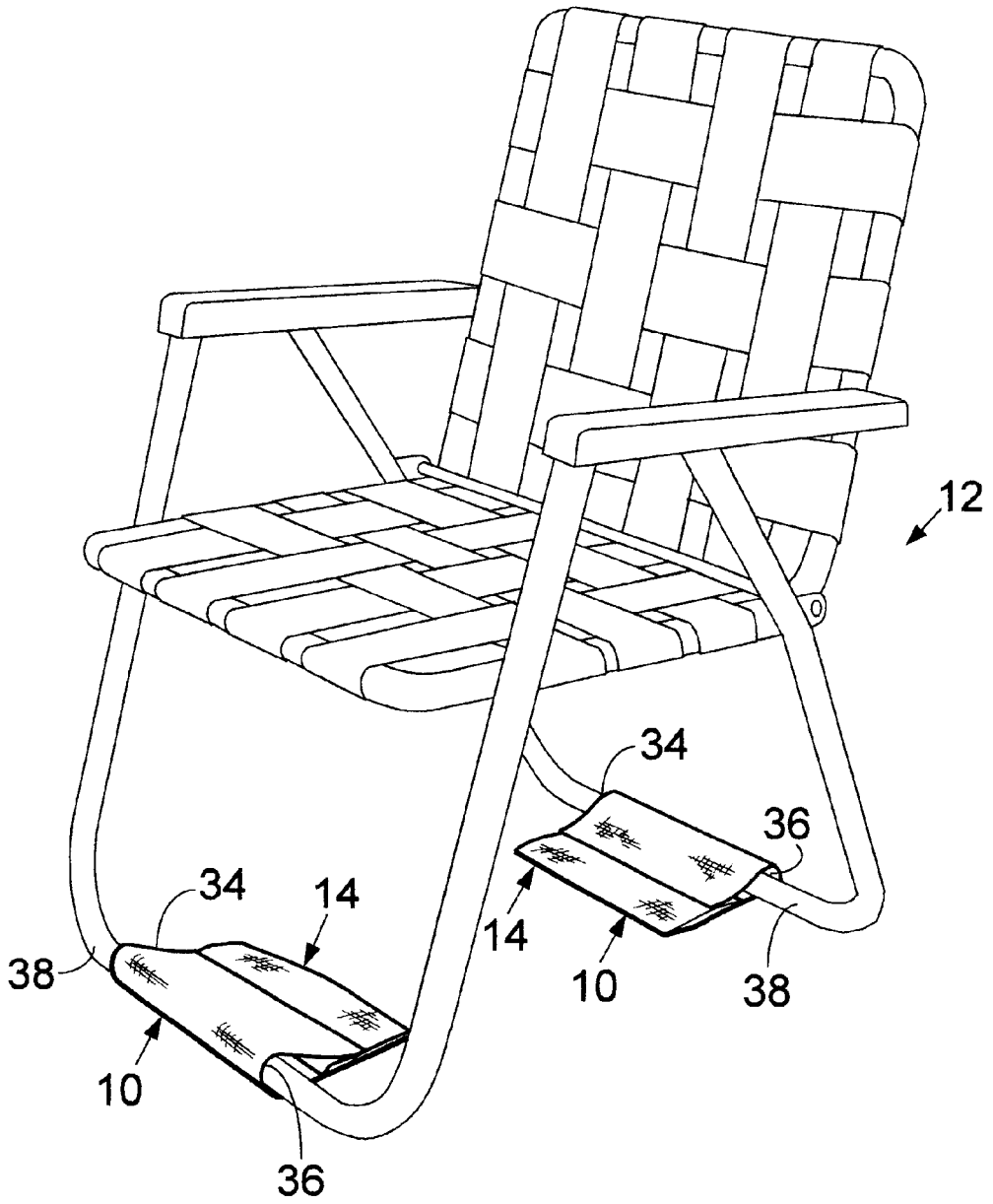
FIG. 6 is a perspective representation of two portable hold down devices constructed in accordance with the present invention with each portable hold down device being disposed on a separate horizontal disposed lower rung of a portable object, such as a portable folding chair.
Figure 7:
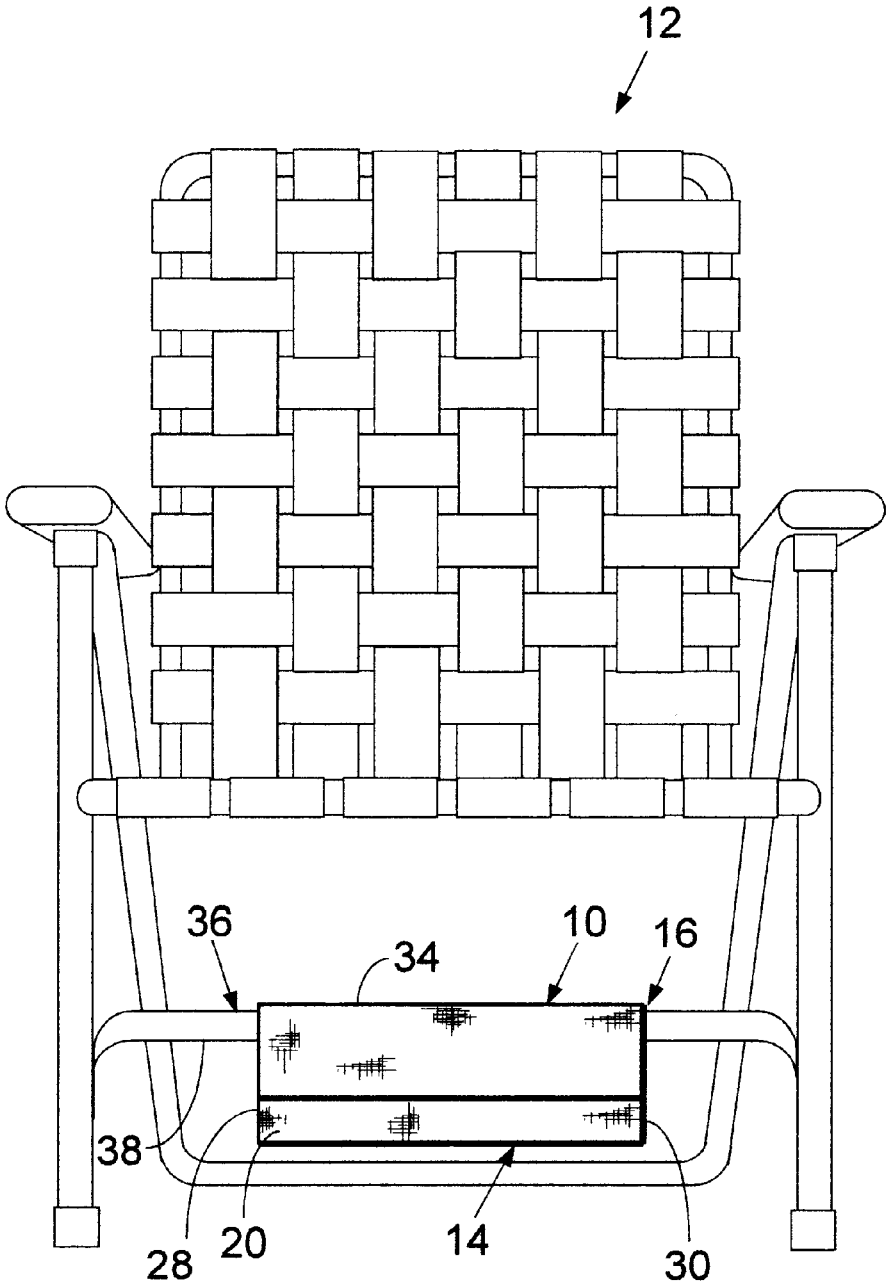
FIG. 7 is a perspective representation of the portable hold down device disposed on yet another type of portable folding chair.

The portable object 12 shown in FIG. 1 is a portable, folding chair merely by way of example. In FIGS. 6 and 7, the portable object 12 is shown as different types of portable folding chairs, merely by way of example. It should be understood that the portable object 12 can be any lightweight, portable object such as portable chair, a polymeric folding picnic table, or camping matt which may be moved and/or blown over in medium to high winds.

The portable hold down device 10 includes a hold down assembly 14, a first connector assembly 16, and a second connector assembly 18. The hold down assembly 14 has a weight sufficient to maintain the portable object 12 in a substantially stable condition so that the wind has difficulty tipping or moving the portable object 12 about when the portable hold down device 10 is connected to the portable object 12. The weight of the hold down assembly 14 can vary widely, and will typically depend on the particular portable object 12 which the hold down assembly 14 is intended to maintain in the substantially stable condition. For example, when the portable object 12 is the folding chair, the weight of the hold down assembly 14 can be in a range from about 2–10 pounds.

Figure 5:
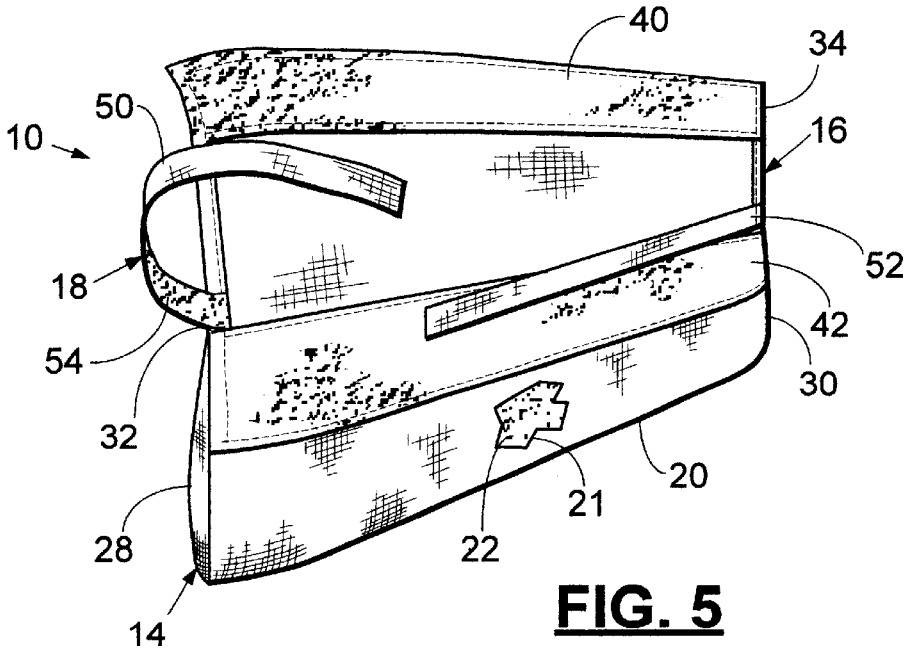
FIG. 5 is a perspective representation of the portable hold down device having the flexible flap member extending outwardly from a hold down assembly.

As best shown in FIG. 5, the hold down assembly 14 can be constructed of a flexible, outer shell 20 defining a cavity 21 filled with an aggregate material 21. The aggregate material 21 can be any suitable material, such as gravel, sand, or the like. The flexible outer shell 20 can be constructed of any suitable material capable of maintaining the aggregate material 22 within the cavity 21. For example, the outer shell 20 can be constructed of canvas or material. The hold down assembly 14 can have any suitable shape, such as the rectangular shape depicted in FIGS. 1–6. It should be understood that the hold down assembly 14 can have any suitable shape, such as a geometric shape, non-geometric shape, fanciful shape, and combinations thereof. For example, the hold down assembly 14 can be the shape of an animal, such as a dog or a cat, a circle, or a triangle.

At least a portion of one of the first and second connector assemblies 16 and 18 are wrapped about at least a portion of the portable object 12 to substantially encompass at least the portion of the portable object 12 whereby the portable object 12 is maintained in the substantially stable condition by the weight of the aggregate material 22.

The hold down assembly 14 has a first end 28, an opposed second end 30, and a first side 32 extending between the first end 28 and the second end 30. The first connector assembly 16 is fastened to the hold down assembly 14 via any suitable method, such as stitching, glue or combinations thereof. The first connector assembly 16 is removably connectable to the portable object 12 whereby when the first connector assembly 16 is connected to the portable object 12, the portable object 12 is maintained in the substantially stable condition.

In one embodiment, the first connector assembly 16 includes a flexible flap member 34 capable of developing a chamber 36 sized to receive at least a portion of the portable object 12. As best shown in FIG. 6, the flexible flap member 34 can be disposed about a horizontally disposed lower rung 38 of the portable chair, when the portable object 12 is the portable chair. The flexible flap member 34 is wrappable about at least the portion of the object 12 (for example, the horizontally disposed lower rung 38) to substantially encompass at least the portion of the portable object 12.

As best shown in FIG. 5, the flap member 34 may extend a distance from the first side 32 of the hold down assembly 14. In the example depicted in FIG. 5, the flexible flap member 34 extends across substantially the entire first side 32 of the hold down assembly 14. The flexible flap member 34 can have a length 39 which can vary widely depending on the expected size of the chamber 36. For example, the length 39 of the flexible flap member 34 can be in a range of about 4 to about 10 inches when the portable object 12 is the portable folding chair.

The first connector assembly 16 also includes a first mating portion 40, and a second mating portion 42. The first mating portion 40 is positioned on, and secured to, at least a portion of the flexible flap member 34. As best shown in FIG. 5, the first mating portion 40 can be disposed substantially across the entire flexible flap member 34. Alternatively, the first mating portion 40 can be disposed intermittently across the flexible flap member 34, or in a spot(s), or a strip(s) across the flexible flap member 34. The second mating portion 42 is positioned for matingly engaging the first mating portion 40 when the flexible flap member 34 is wrapped about at least a portion of the portable object 12 to thereby maintain the flexible flap member 34 wrapped about the portion of the portable object 12 to thereby stabilize the portable object 12. The second mating portion 42 can be positioned on and secured to the flexible outer shell 20 of the hold down assembly 14. The second mating portion 42 can extend across the entire hold down assembly 14, from the first end 28 to the second end 30 thereof. Alternatively, the second mating portion 42 can be disposed in strips, spots or in an intermittent pattern on the flexible outer shell 20.

The first and second mating portions 40 and 42 can be any device or assembly which can be fastened together to removably connect the first and second mating portions 40 and 42 so that the first and second mating portions 40 and 42 can be separated. Once the first and second mating portions 40 and 42 are separated, the flexible flap member 34 can be unwrapped about the portion of the portable object 12 and removed from the portable object 12. For example, the first and second mating portions 40 and 42 can be corresponding portions of a hook and eye fastener, such as a Velcro brand hook and eye fastener, a zipper, snaps, magnets, plastic buckles, metal buckles, hooks and combinations thereof. Moreover, it should be understood that the first connector assembly 16 may be constructed of other assemblies or devices for removably connecting the hold down assembly 14 to the portable object 12.

The second connector assembly 18 is supported by and connected to at least one of the hold down assembly 14, and the first connector assembly 16 so as to be extendable outwardly therefrom. The second connector assembly 18 is removably connectable to at least a portion of the portable object 12 desirably having a different orientation then the portion of the portable object 12 to which the first connector assembly 16 is removably connectable. For example, as shown in FIG. 1, the second connector assembly 18 is removably connectable to a pair of corresponding, angularly disposed lower rungs 44 of the portable object 12.

In one embodiment, the second connector assembly 18 includes a first flexible strap 50 extending outwardly from the first end 28 of the hold down assembly 14, and a second flexible strap 52 extending outwardly from the second end 30 of the hold down assembly 14. The first and second straps 50 and 52 are selectively disposable about separate, respective portions of the portable object 12, such as the angularly disposed lower rungs 44. The first and second flexible straps 50 and 52 each have a mating portion 54 and 56, secured thereto, which can mate with the second mating portion 42 of the first connector assembly 16 so as to removably maintain the respective first and second flexible straps 50 and 52 about the separate, respective portions of the portable object 12 as discussed herein above. Alternatively, the second connector assembly 18 can be provided with a mating portion or portions which is/are separate from the second mating portion 42 of the first connector assembly 16 for mating with one or both of the mating portions 54 and 56. The mating portions 54 and 56 can be portions of a hook and eye fastener, such as a Velcro brand hook and eye fastener, a zipper, snaps, magnets, plastic buckles, metal buckles, hooks and combinations thereof. Moreover, it should be understood that the second connector assembly 18 may be constructed of other assemblies or devices for removably connecting the hold down assembly 14 to the portable object 12.

It should be understood that more than one of the portable hold down devices 10 can be removably attached to a single portable object 12 to more securely stabilize the portable object 12, or to permit the weight of the hold down assembly 14 to be reduced. For example, two of the portable hold down devices 10 are illustrated in FIG. 6. Both of the portable hold down devices 10 shown in FIG. 6 are removable connected to separate horizontally disposed lower rungs of the portable object 12, which in the example shown in FIG. 6 is the portable folding chair.

Referring to FIG. 6, to removably connect the portable hold down device 10 to the portable object 12 with the first connector assembly 16, the first mating portion 40 is removed from the second mating portion 42 such that the flexible flap member 34 can be extended away from the hold down assembly 14, as shown in FIG. 5. Then, the portable hold down device 10 is positioned adjacent to the portable object 12, and the flexible flap member 34 is wrapped about a portion of the portable object 12, such as the horizontally disposed lower rung 38, until the first mating portion 40 engages the second mating portion 42 to secure the flexible flap member 34 in the wrapped position.

To remove the portable hold down device 10 from the portable object 12, when the portable hold down device 10 is removably connected to the portable object 12 via the first connector assembly 16, the before-mentioned process is generally reversed. That is, the first mating portion 40 is removed from the second mating portion 42 such that the flexible flap member 34 can be unwrapped from about the portion of the portable object 12, such as the horizontally disposed lower rung 38. Once the flexible flap member 34 is unwrapped from about the portion of the portable object 12, the portable hold down device 10 is moved away from the portable object 12.

Figure 2:
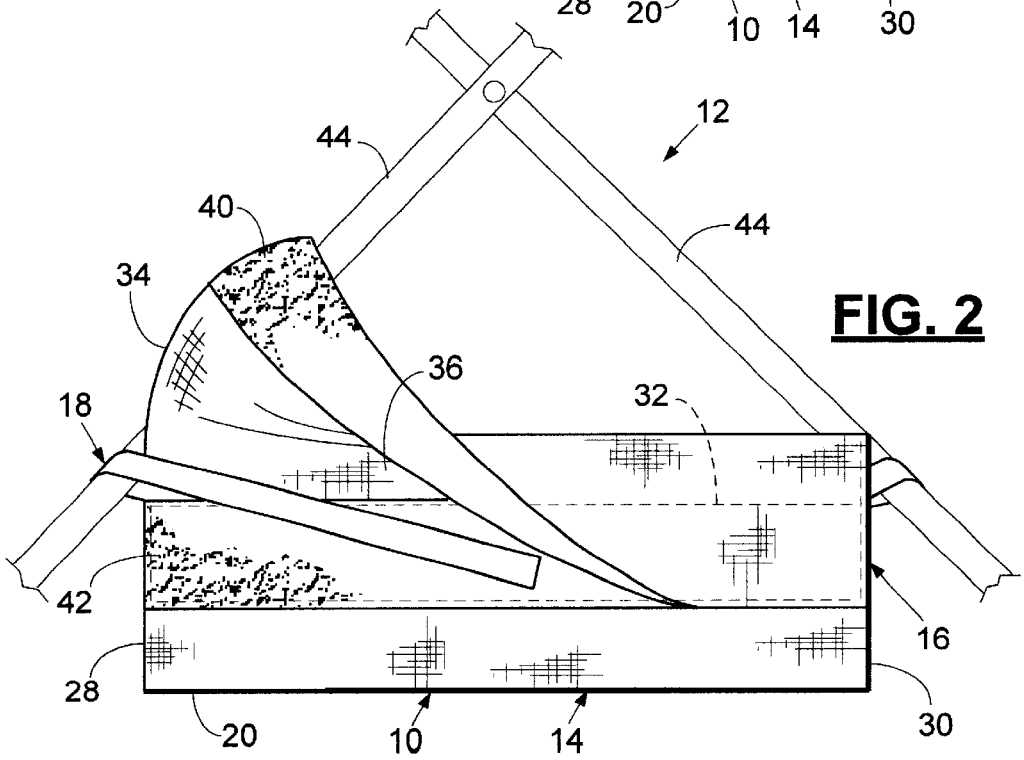
FIG. 2 is a side elevational representation of the portable hold down device depicted in FIG. 1 wherein a flexible flap member of the portable hold down device has been extended.
Figure 3:
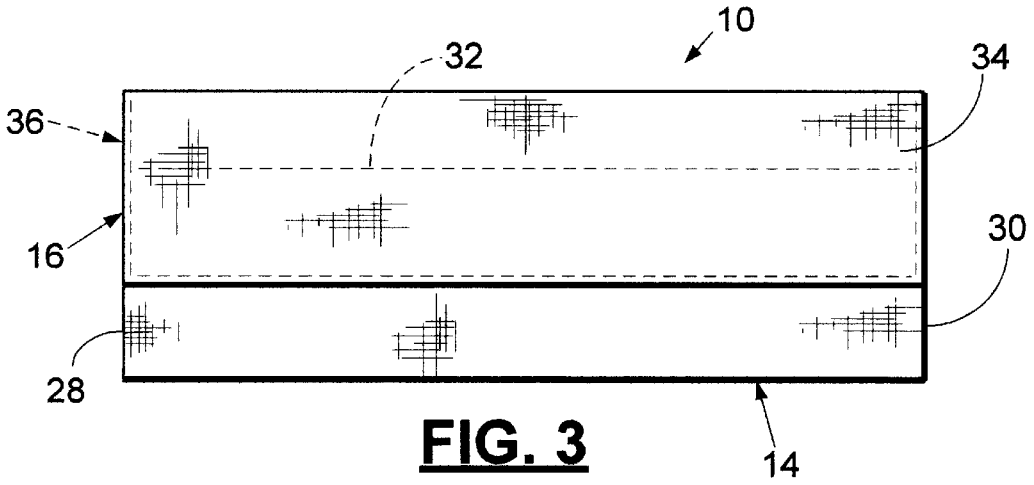
FIG. 3 is a top plan representation of the portable hold down device.
Figure 4:
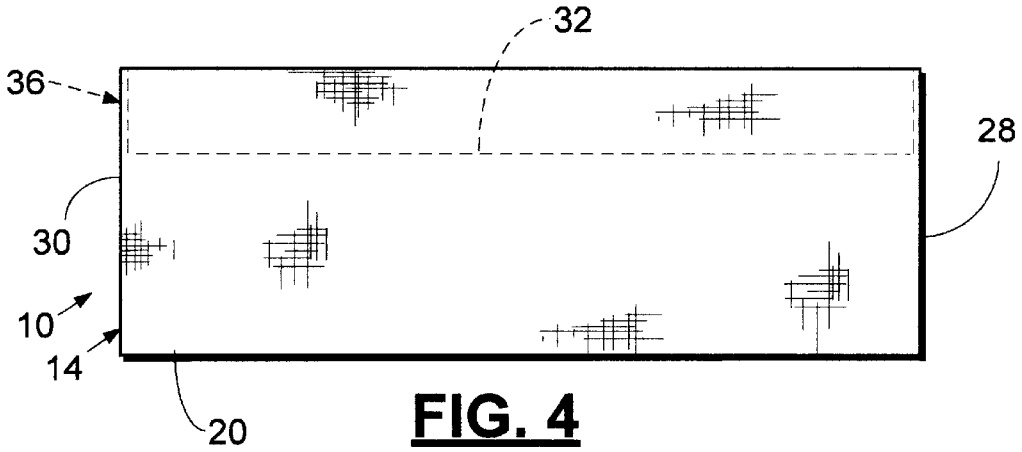
FIG. 4 is a bottom plan representation of the portable hold down device depicted in FIG. 3.

Referring to FIG. 1, to removably connect the portable hold down device 10 to the portable object 12 with the second connector assembly 16, the first mating portion 40 is removed from the second mating portion 42 such that the flexible flap member 34 can be extended away from the hold down assembly 14, as shown in FIG. 5. Then, the portable hold down device 10 is positioned adjacent to the portable object 12, and the first and second flexible straps 50 and 52 are wrapped about respective portions of the portable object 12, such as the angularly disposed lower rungs 44, until the mating portions 54 on the first and second flexible straps 50 and 52 engages the second mating portion 42 to secure the portable hold down device 10 to the portable object 12. Once the portable hold down device 10 is secured to the portable object 12 via the second connector assembly 18, the flexible flap member 34 then can be disposed adjacent to the hold down assembly 14 (as shown in FIGS. 1–3). The portable hold down device 10 can then be removed from the portable object 12 by reversing the order of the process described herein above with reference to FIG. 1.

From the above description it is clear that the present invention is well adapted to carry out the objects and to attain the advantages mentioned herein as well as those inherent in the invention. While a presently preferred embodiment of the invention has been described for purposes of this disclosure, it will be understood that numerous changes may be made which will readily suggest themselves to those skilled in the art and which are accomplished within the spirit of the invention disclosed and as defined in the appended claims.

What is claimed is:

1. A portable hold down device in combination with a portable chair for maintaining the portable chair in a substantially stable condition, the portable hold down device comprising:

a portable hold down assembly comprising an outer shell of a flexible material and having a first end and a second opposed end and a first side extending between the first and second ends and filled with an aggregate material so as to provide a weight sufficient to maintain the portable chair in the substantially stable condition when the hold down assembly is connected to the portable chair; and a first connector assembly fastened to the said first side, the first connector assembly including a flexible flap member of said flexible material; and a second connector assembly including a first and second flexible strap extending outwardly from said first and second ends, respectively, wherein at least a portion of one of the first and second connector assemblies are wrapped about at least a portion of the portable chair to substantially encompass at least the portion of the portable chair whereby the portable chair is maintained in the substantially stable condition by the weight of the aggregate material.

2. A portable hold down device, as defined in claim 1, wherein the first connector assembly further comprises:

a first mating portion secured to at least a portion of the flexible flap member; and a second mating portion positioned for matingly engaging the first mating portion when the flexible flap member is wrapped about at least a portion of the portable chair so as to maintain the flexible flap member in the wrapped condition and thereby secure the hold down assembly to the portable chair.

3. A portable hold down device as defined in claim 1, wherein the flexible flap member extends a distance outwardly from the first side of the hold down assembly.

4. A portable hold down device as defined in claim 3, wherein the flexible flap member extends across substantially the entire first side of the hold down assembly.

5. A portable hold down device as defined in claim 2, wherein the second mating portion is connected to the hold down assembly.

6. A portable hold down device as defined in claim 1, wherein said second connector assembly is:

supported by at least one of the hold down assembly and the first connector assembly so as to be extendable outwardly therefrom, the second connector assembly being removably connectable to at least a portion of the portable chair having a different orientation than the portion of the portable chair to which the first connector assembly is removably connectable.

7. A portable hold down device as defined in claim 1, wherein the first and second flexible straps are removably connectable to at least a portion of the first connector assembly.

* * * * *